United States Patent [19]

Rabe

[11] Patent Number: 4,779,445

[45] Date of Patent: Oct. 25, 1988

[54] SLEEVE TO TUBE EXPANDER DEVICE

[75] Inventor: George B. Rabe, Sparta, N.J.

[73] Assignee: Foster Wheeler Energy Corporation, Clinton, N.J.

[21] Appl. No.: 100,690

[22] Filed: Sep. 24, 1987

[51] Int. Cl.[4] ..... B21D 41/02

[52] U.S. Cl. ..... 72/393; 29/157.4; 29/523; 29/283.5; 29/727

[58] Field of Search ..... 29/727, 283.5, 157.4, 29/523; 72/393

[56] References Cited

U.S. PATENT DOCUMENTS

| | | | |
|---|---|---|---|
| 688,429 | 12/1901 | Monroe | 72/393 |
| 691,446 | 1/1902 | Colby | 72/393 |
| 1,153,663 | 9/1915 | Wiedeke | 72/393 |
| 2,319,216 | 5/1943 | Dewald | 72/393 |
| 3,470,724 | 10/1969 | Gregg | 72/393 X |
| 3,829,948 | 8/1974 | Miller et al. | 29/727 |
| 4,583,388 | 4/1986 | Hogenhout | 72/393 |
| 4,654,943 | 4/1987 | Rabe | 29/727 X |

FOREIGN PATENT DOCUMENTS

| | | | |
|---|---|---|---|
| 1309708 | 3/1973 | United Kingdom | 72/393 |

*Primary Examiner*—Charlie T. Moon

*Attorney, Agent, or Firm*—Marvin A. Naigur; Martin Smolowitz

[57] ABSTRACT

An elongated tool device adapted for use in installing a tubular sleeve within a tube and forming a pressure-tight seal therebetween. The tool device includes a housing having a reduced-diameter forward extension portion attached to a front cylinder, and containing a rear piston. The front cylinder is attached to a collet having multiple radially expandable fingers and contains a front piston attached to a tapered mandrel which is axially movable within the fingers, and has a forward tapered nose portion to facilitate inserting the tool into a tube. The rear piston is attached to the front piston by an elongated rod. By pressurizing the tool front piston by a hydraulic fluid pressurizing unit, the mandrel is forced forward through the collet fingers to expand the fingers and sleeve tightly into the tube to form the seal joint. After withdrawing the tool from the tube, the tool rear piston is similarly pressurized to retract the front piston and attached mandrel back through the collet expandable fingers to reset the tool prior to its further use. A method for utilizing the tool device to locate a sleeve within a tube and then pressure-tightly seal the sleeve within the tube is also disclosed.

8 Claims, 3 Drawing Sheets

SLEEVE TO TUBE EXPANDER DEVICE

BACKGROUND OF INVENTION

This invention pertains to an elongated tool device adapted for remotely expanding a tubular sleeve into a surrounding tube to provide a seal therebetween. It pertains particularly to such a tool device containing dual internal pistons which are pressurized in sequence to expand collet fingers radially into the close-fitting sleeve and provide a leak-tight seal between the sleeve and surrounding tube.

Tubes in heat exchangers, particularly tubes in air preheaters used in fossil fuel fired steam power plants for preheating the combustion air against hot flue gas, often develop leaks after several years service due to metal corrosion, erosion or fatigue and require repair or replacement. Such tube leaks are usually located near the tubesheet but can occur anywhere along the tubes. Because replacement of tubes in such heat exchangers is quite expensive, particularly for large heat exchangers containing 10,000–50,000 tubes, and requires considerable outage time for a plant, a tool device method for reliably repairing such tubes quickly and inexpensively in a dusty environment has been needed.

Various devices for remotely expanding tubes into plates or tubesheets are known in the prior art. For example, U.S. Pat. No. 2,319,216 to Dewald discloses a pull-type tapered tube expander for expanding heat exchanger tubes into a tubesheet utilizing direct contact between a tapered wedge surface and the tube inner wall. U.S. Pat. No. 3,470,724 to Gregg discloses a pipe end forming machine which utilizes an external holding collet to hold a tube end and a central tapered arbor which is pushed through a forming collet to locally expand the tube end. U.S. Pat. No. 3,829,948 to Miller et al discloses an apparatus for expanding tubes into a tubesheet using an expandable collet. U.S. Pat. No. 4,182,152 to Vaill et al discloses a grid sleeve bulge tool used for securing internal guide tubes to an outer sleeve and grid. Also, U.S. Pat. No. 4,471,643 to Champoux et al discloses a tool adapted for pulling a tapered mandrel through a sleeve to secure together abutting workpieces. Furthermore, copending application Ser. No. 831,888 filed Feb. 24, 1986 discloses an elongated tube expander tool and method which is somewhat similar to the present invention.

The known prior art has various deficiencies, and has apparently not provided a self-contained tool device and method for remotely expanding a close-fitting tubular sleeve into a surrounding tube quickly and conveniently, so as to provide a pressure-tight joint therebetween. However, a tube repair method for inserting an elongated close-fitting metal sleeve into a tube and radially expanding and pressure sealing the sleeve to the tube inner wall by using an improved elongated pressure-operated tool device has now been developed according to the present invention.

SUMMARY OF INVENTION

The present invention provides an elongated tool device adapted for remotely expanding a sleeve into a surrounding tube to provide a pressure-tight seal therebetween. The tool device includes a housing and an elongated forward extension portion attached to a front cylinder containing an axially movable piston pressurizable through a first port in the housing. The front cylinder is attached to an expandable collet having a plurality of radially movable fingers located at its forward end. A tapered mandrel attached to the piston forward end has an enlarged diameter at its rearward end, and is arranged to be moved by the front piston axially forward through the collet to expand the collet fingers radially outwardly against the inner wall of the sleeve into which the tool is inserted. The collet fingers force a localized portion of the sleeve radially outwardly until it contacts the tube, and then radially expands the sleeve and tube together, to radially outwardly form a positive lock and seal joint between sleeve and tube.

The mandrel also has an oppositely tapered reduced diameter portion located adjacent the rear end of the mandrel, so that upon further mandrel forward movement the reduced diameter portion permits the collet fingers to retract radially. Such retraction of the collet fingers permits the tool device to be withdrawn from the tubular sleeve and the surrounding tube to which the sleeve has been sealed.

The tool housing extension portion also has a rear cylinder containing an axially movable piston rigidly connected to the front piston by a central connecting rod, and pressurizable through a second port in the housing. Following withdrawal of the tool device from a tube, pressurizing the rear piston in the tool housing will move the mandrel rearwardly through the collet fingers to its original position, so as to reset the tool ready for repeated usage.

This invention also includes a method for utilizing the elongated tool device for remotely expanding a close-fitting sleeve into a surrounding tube. The method includes the steps of inserting an elongated close-fitting tubular sleeve into a tube so as to extend past any opening in the tube, then inserting the elongated extension portion of the tool into the sleeve and its surrounding tube, so that collet fingers of the tool are located near the forward or inner end of the sleeve. Next, the tool front piston is pressurized so as to force a tapered mandrel attached to the piston forward through a plurality of radially expandable collet fingers, so as to expand the fingers radially outwardly against the inner surface of the sleeve and also expand the sleeve firmly against the tube inner wall, so as to provide an interference fit and seal therebetween. The tool front piston is further pressurized to force the mandrel further forward through the collet fingers to contact a reduced diameter portion so as to retract the fingers, after which the tool is withdrawn from the sealed sleeve and tube. Finally, a rear piston of the tool device is pressurized to retract the mandrel rearwardly through the collet fingers to its original position to reset the tool ready for a new cycle of operation for the tool device.

This invention advantageously provides a special elongated tool device which is adapted for being inserted into a close-fitting sleeve and tube in a heat exchanger and expanding the sleeve into the tube to provide a leak-tight seal therebetween. The invention also provides a method for effective repair to corroded or ruptured tubes and thereby avoid expensive and time consuming rebuilding or replacement of the heat exchanger.

BRIEF DESCRIPTION OF DRAWINGS

The invention will be described further with reference to the following drawings, in which.

DESCRIPTION OF INVENTION

Figure 1:
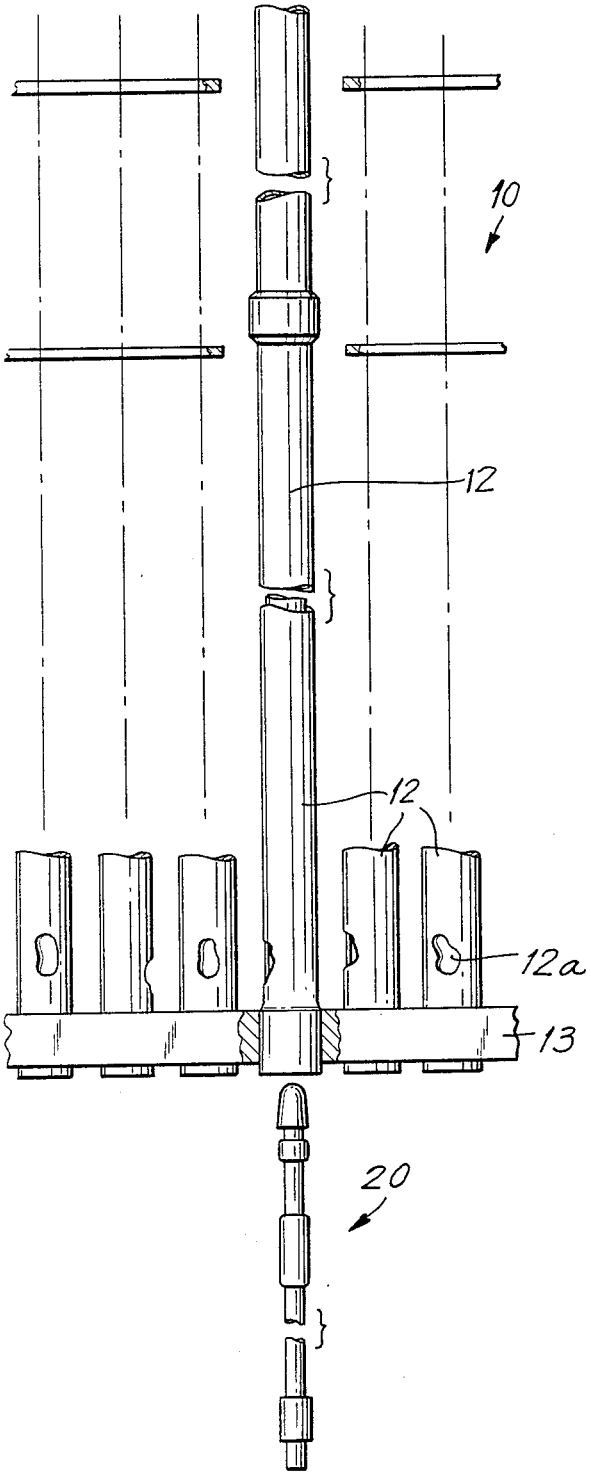
FIG. 1 shows a perspective elevation view of a portion of a heat exchanger containing a plurality of tubes, and a pressurizable tool device used for expanding a sleeve into leaking tubes of the heat exchanger.
Figure 1A:
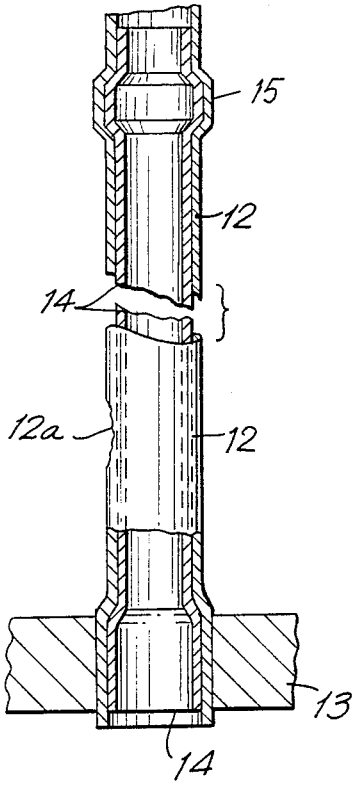
FIG. 1A shows an enlarged partial sectional view of a sleeve expanded within a tube and tubesheet of the heat exchanger to provide a seal joint.

As generally shown in FIG. 1, a vertical tubular heat exchanger 10 has a plurality of tubes 12 expanded at their lower ends into tube sheet 13. Some of the tubes 12 contain ruptures at 12*a* which are to be repaired by inserting an elongated close-fitting tubular sleeve 14 into each tube past the rupture 12*a*, and locally expanding the sleeve at 15 against the inner wall of the tube 12 so as to repair the rupture 12*a* by providing a pressure-tight joint at each end of the sleeve 14, as is shown in greater detail by FIG. 1A. Such tube repair joint 15 at the tube inner end is made by using a special elongated tool device 20 according to the present invention. The sleeve lower end is subsequently sealed pressure-tightly to the tube by using another tool such as described by a co-pending application.

Figure 2:
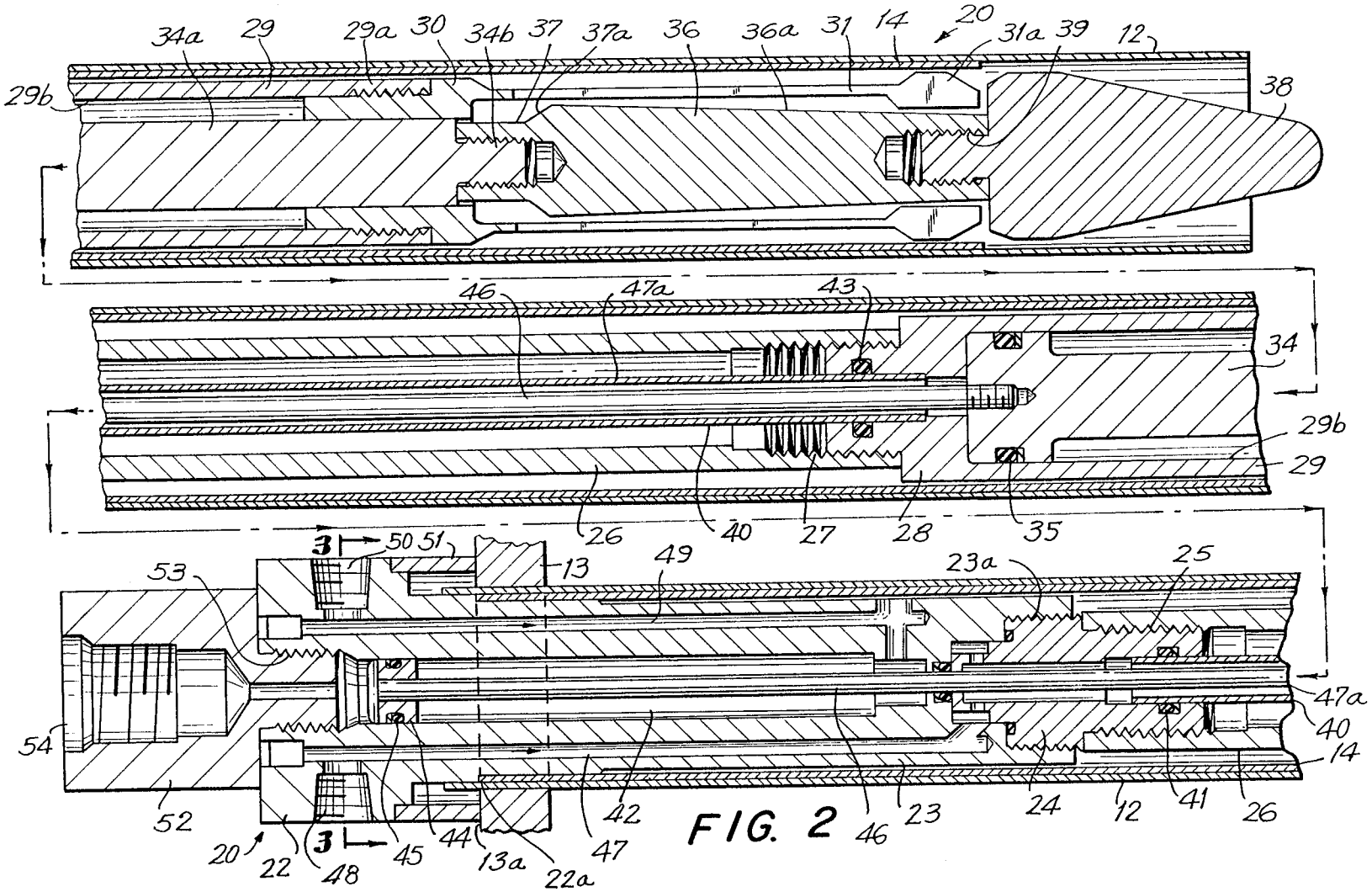
FIG. 2 shows a longitudinal cross-sectional view of the elongated tool device inserted into a sleeve in a tube, with the collet fingers in their normal unexpanded position relative to the sleeve.

As shown by FIG. 2, the elongated tool device 20 includes a housing 22 which has an elongated cylindrical shaped front portion 23 having reduced diameter so as to be inserted within sleeve 14 and both are then inserted within tube 12. An adapter 24 is threadably attached to the forward end of extension portion 23 by threaded joint 23*a*, and outer spacer tube 26 is threaded onto the other end of adapter 24 by threads 25.

A cylinder 28 is threadably attached at 27 to the forward end of spacer tube 26. Cylinder assembly 28 includes a collet 30 which is threaded at 29*a* onto the forward end of cylinder 29. Collet 30 has at least three radially expandable fingers 31. The forward end of each collet finger 31 has an outwardly enlarged portion 31*a* shaped so as to contact and force an adjacent portion of sleeve 14 radially outwardly against tube 12, so as to deform the sleeve firmly into the tube and thereby provide a pressure-tight seal therebetween.

The cylinder 29 has a cylindrical bore 29*b*, which contains a piston 34 having a seal ring 35 and an elongated front portion 34*a*. The piston front portion is threadably attached at 34*b* to an elongated mandrel 36 having an outer surface 36*a*, which is tapered rearwardly so as to have an enlarged diameter at its rearward end. The tapered surface 36*a* is located adjacent a reduced diameter portion 37 and oppositely tapered portion 37*a* provided at the rear end of the mandrel 36. A tapered nose piece 38 is threadably attached at 39 to the forward end of the mandrel 36, to facilitate inserting the tool assembly 20 into the sleeve 14 and tube 12, as is generally shown in FIG. 2.

An inner spacer tube 40 also extends between adapter 24 and cylinder assembly 28 and is pressure sealed to the adapter 24 by seal ring 41, and is sealed to cylinder assembly 28 by seal ring 43. The front piston 34 is pressurized and moved forward by fluid pressure being applied at sleeve expansion port 48 in housing 22, which port is connected to piston 34 by an annular passageway 47 provided in housing extension 23 and connecting annular passageway 47*a* located between the inner spacer tube 40 and a connecting rod 46 as described below.

Figure 3:
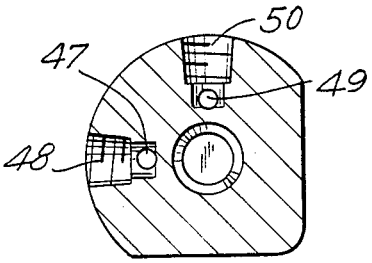
FIG. 3 shows a cross-sectional view of the tool housing taken at section 3—3′ of FIG. 2.

Located within the rear end of the tool housing 22 is a second cylindrical bore 42 containing an axially movable rear piston 44 containing a seal ring 45. The rear piston 44 is attached by central elongated connecting rod 46 extending through the inner spacer tube 40 to near the forward piston 34. The front side of rear piston 44 is pressurized through a longitudinal passageway 49 which is flow connected to piston retracting port 50 of housing 22. The rear end of housing 22 is closed by a plug 52 attached by threaded joint 53. Also if desired, reduced fluid pressure can be applied at port 54 to the rear side of piston 44 to augment the pressure applied through port 48 and passageway 47 and force mandrel 36 forward through the collet fingers 31. The relative locations of sleeve expansion port 48 and piston retraction ports 50 are shown by FIG. 3.

The tool device forward portion 23 and cylinder assembly 28 is made to have whatever diameter is needed to be easily inserted into a snug-fitting sleeve 14 within tube 12, and to have a length sufficient to pressure seal the inner end of the sleeve to the tube at joint 15. The tool housing outside diameter may be 2–3 inches, and its total length may be 4–8 feet. The tool is usually made about 6 feet long and its extension portion have a reduced outside diameter so as to slidably fit inside a close-fitting sleeve in a 1–2 inch diameter tube. The taper of the mandrel 36 is made relatively small so as to limit the axial force necessary to force the collet fingers 31 radially outwardly to expand the sleeve 14 into tube 12. The radial force required at the finger ends 31*a* is determined by the diameter, wall thickness and yield strength of both the sleeve 14 and tube 12 and the deformation need to produce pressure-tight seal 15. The total radial force and the coefficient of friction between the mandrel surface and collet finger determines the axial force needed from piston 34 to drive forward the mandrel 26. The amount of taper may vary between about 0.050–0.065 inch diameter per inch length of the tapered mandrel. The mandrel outer surface 36*a* is usually coated with a material having low coefficient of friction such as molybdenum disulfide to minimize the friction between the tapered mandrel and the collet fingers.

Housing 22 has a shoulder 22*a* which is sized to fit within tube 12 and against the end of sleeve 14. Also, a spacer piece 51 is provided attached to the front end of housing 22. During use of tool 20, the forward end of spacer piece 51 is placed against the front face 13*a* of tubesheet 13 to facilitate proper location of the enlarged portion 31*a* of collet fingers 31 relative to the inner end of sleeve 14 to produce joint 15.

The tool device is usually made of high strength alloy steel, with the mandrel 36 being made of hardened high carbon tool steel. The number of collet fingers 31 will vary with the diameter of the collet and sleeve 14. For example, for a sleeve outside diameter of 1.4 inch 6 collet fingers have been used, and for a sleeve outside diameter of 2.9 inches 12 collet fingers have been used.

The method steps for using this invention include first placing an elongated tubular sleeve 14 onto the forward end of tool 20, then inserting the tool 20 and sleeve 14 into a tube 12 which is to be repaired, as shown in FIG. 2. The tool is connected by suitable high pressure hoses to a hydraulic pressurizing unit (not shown). The spacer ring 51 attached to the tool housing 22 forward end is abutted against the face 13*a* of tubesheet 13. Also, shoulder 22*a* of housing 22 serves to force forward the sleeve 14 and properly axially locate the sleeve within the tube 12 for forming joint 15 therebetween.

Figure 4:
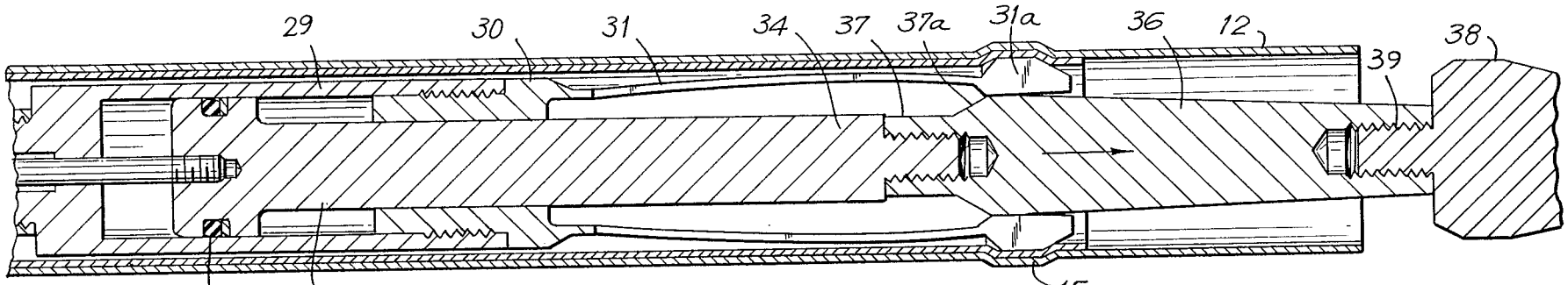
FIG. 4 shows a partial cross-sectional view of the tool after being pressurized, with the collet fingers being in an expanded position within the sleeve and tube.

After inserting the tool 20 within a sleeve 14 and properly locating the sleeve 14 within the tube 12, the tool 20 is first pressurized at sleeve expansion port 48 to 3500–4500 psig hydraulic pressure so as to move forward piston 34 and tapered mandrel 36 and force collet fingers 31 radially outwardly against the sleeve 14 and tube 12, and then further radially expand the sleeve and tube together outwardly and form a positive lock and seal 15 between the sleeve and tube, as is shown by FIG. 4.

Figure 5:
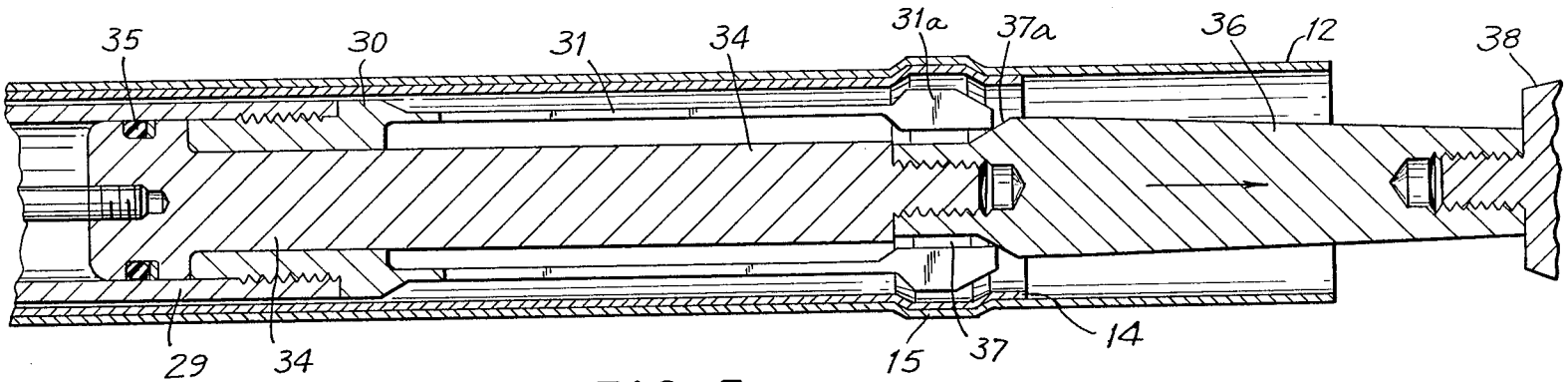
FIG. 5 shows a partial cross-sectional view of the tool showing the mandrel moved to a forward position to retract the collet fingers, and thereby permit withdrawal of the tool from the sleeve and tube.

Further forward movement of mandrel 36 through collet fingers 31 permits the fingers to automatically retract into the mandrel reduced diameter portion 37, as shown by FIG. 5. The tool 20 is then withdrawn from the expanded sleeve and tube 12, after which port 50 is pressurized using a hydraulic fluid 3500–4500 psig pressure to move the rear piston 44 rearwardly and thereby recock the tool by withdrawing the tapered mandrel 36 from the collet fingers 31 to the initial position as shown by FIG. 2.

This invention will be further described by the following example of a tool and tube configuration, which should not be considered as limiting the scope of the invention.

EXAMPLE

A sleeve to tube expander tool device according to the invention is constructed and utilized for pressure-tight sealing the inner end of sleeves into tubes of an air preheater in a power plant. The heat exchanger and tool device have the following typical dimensions and characteristics.

Tube inside diameter, in.—1.834
Sleeve length, in.—78
Sleeve outside diameter, in.—1.800
Sleeve inside diameter, in.—1.634
Tool length, in.—83
Tool housing outside diameter, in.—2.5
Front piston diameter, in.—1.31
Rear piston diameter, in.—0.56
Number of collet fingers—10
Pressure on front piston, psig—4000
Pressure on rear piston, psig—4000

During use, the tool device forward extension end is first inserted into an elongated metal sleeve provided in a tube of the heat exchanger, and pushed forward against the tubesheet so that the tool collet fingers are positioned near the front or inner end of the sleeve. The tool front piston is pressurized by a hydraulic fluid pressurizing unit connected to the tool, and the tapered mandrel is forced forward to expand the collet fingers and expand the sleeve firmly against the tube and then expand the tube and sleeve together radially outwardly, forming a positive lock and seal between the sleeve and tube. This pressurizing and sleeve sealing step usually takes 10–15 seconds time. Next, the tool is withdrawn from the sleeve and tube, after which the tool rear piston port is pressurized by the pressurizing unit, and the mandrel withdrawn through the collet fingers to prepare the tool for its next cycle of use. This procedure is repeated for each tube being repaired, using the method of the invention.

Although this invention has been described broadly and in terms of a specific embodiment, it is apparent that modifications and variations can be made to the tool device and method of use within the scope of the invention, which is defined by the following claims.

I claim:

1. An elongated tool device adapted for remotely expanding a tubular sleeve into a surrounding tube, comprising:

(a) a housing having first and second ports provided therein, said housing having a forward extension portion which is attached to a front cylinder;

(b) a collet attached to said front cylinder at its forward end, said collet having at least three radially expandable fingers located at the collet forward end;

(c) a front piston axially movable within said front cylinder, said front piston being connected to an elongated tapered mandrel having an enlarged diameter at its rearward end and an adajcent longitudinally extended rearwardly inwardly tapered reduced diameter portion, said mandrel being axially slidable in said collet and connected to a front guide portion;

(d) a rear cylinder located within said housing and containing a rear piston which is rigidly connected to said front piston by a centrally located rod extending therebetween; and (e) an elongated tube centrally disposed around said rod, said tube being arranged for supplying fluid pressure from said first housing port to the rear end of said front piston, said housing having said first port flow connected to the rear end of the front piston and said second port flow connected to the forward end of the rear piston, whereby the tool forward extension portion can be inserted into a tubular sleeve and the front piston pressurized to move forward the tapered mandrel so as to radially expand the collet fingers against the sleeve and thereby expand the sleeve firmly into a tube to seal the sleeve into the tube.

2. A tool according to claim 1, wherein a spacer ring is attached to the forward end of said housing for axially locating said collet within the sleeve.

3. A tool according to claim 1, wherein said front cylinder is threadably attached to said housing forward extension by an elongated spacer tube to provide for adjustment of the tool length.

4. A tool according to claim 1, wherein said front guide portion is a tapered nose piece having an outer diameter slightly less than that of the collet and is rigidly attached to the forward end of said tapered mandrel.

5. A tool according to claim 1, wherein said mandrel forward portion has a diametral taper of 0.050–0.065 inch per inch of mandrel length.

6. A tool according to claim 1, wherein said housing contains an auxiliary rear port connected to the rear side of said rear piston, so as to additionally force the mandrel forward against said collet fingers.

7. A tool according to claim 1, wherein said collet has 6–12 radially expandable fingers.

8. An elongated tool device adapted for remotely expanding a tubular sleeve into a surrounding tube to provide a seal therebetween, the tool comprising:

(a) a housing having first and second ports provided therein, said housing having a forward extension portion and a spacer piece attached at its forward end to a front cylinder;

(b) a collet attached to said front cylinder at its forward end, said collet having 6–12 radially expandable fingers located at the collet forward end;

(c) a front piston axially movable within said front cylinder, said front piston being connected to an elongated tapered mandrel having an enlarged diameter at its rearward end and an adjacent longitudinally extended rearwardly inwardly tapered reduced diameter portion, said mandrel being axially slidable in said collet and connected to a front tapered nose guide piece having a diameter slightly less than that of the collet;

(d) a rear cylinder located within said housing and containing a rear piston which is rigidly connected to said front piston by a centrally located rod extending therebetween; and (e) an elongated tube centrally disposed around said rod, said tube being arranged for supplying fluid pressure from said first housing port to the rear end of said front piston, said housing having said first port flow connected to the rear end of the front piston and said second port flow connected to the forward end of the rear piston, whereby the tool forward extension portion can be inserted into a tubular sleeve and the front piston pressurized to move forward the tapered mandrel so as to radially expand the collet fingers against the sleeve and thereby expand the sleeve firmly into a tube to seal the sleeve into the tube.

* * * * *